US006082031A

United States Patent [19]

Heaton et al.

[11] Patent Number: 6,082,031

[45] Date of Patent: Jul. 4, 2000

[54] CANOPY MOUNTING DEVICE FOR EXIT SIGN

[75] Inventors: Thomas K. Heaton, Thomaston; David A. Evarts, Fairfield, both of Conn.

[73] Assignee: Dual-Lite Inc., Cheshire, Conn.

[21] Appl. No.: 09/124,570

[22] Filed: Jul. 29, 1998

[51] Int. Cl.[7] ..... G09F 13/04

[52] U.S. Cl. ..... 40/570; 362/368

[58] Field of Search ..... 40/570; 362/368, 362/147, 404, 432, 812, 370

[56] References Cited

U.S. PATENT DOCUMENTS

| | | | |
|---|---|---|---|
| 1,646,807 | 10/1927 | Benjamin . | |
| 1,933,358 | 10/1933 | Almcrantz . | |
| 3,086,308 | 4/1963 | Ternouth . | |
| 3,798,584 | 3/1974 | Person . | |
| 3,886,349 | 5/1975 | Arai . | |
| 3,931,689 | 1/1976 | Shine . | |
| 4,273,957 | 6/1981 | Kolling, Jr. . | |
| 4,426,126 | 1/1984 | De Vos et al. . | |
| 4,449,168 | 5/1984 | Ewing . | |
| 4,507,719 | 3/1985 | Quioque . | |
| 4,532,579 | 7/1985 | Merryman . | |
| 4,561,203 | 12/1985 | MacDonald, Jr. et al. | 40/570 |
| 4,820,956 | 4/1989 | Slobodzian et al. | 40/541 X |
| 5,018,290 | 5/1991 | Kozek et al. | 40/570 |
| 5,022,627 | 6/1991 | Beghelli | 40/570 X |
| 5,142,454 | 8/1992 | Green . | |
| 5,272,605 | 12/1993 | Johnstone | 40/584 X |
| 5,376,020 | 12/1994 | Jones | 362/147 X |
| 5,461,550 | 10/1995 | Johnstone . | |
| 5,526,251 | 6/1996 | Andre et al. | 40/570 X |
| 5,727,867 | 3/1998 | Johnstone . | |

OTHER PUBLICATIONS

Excite Installation Manual No. 60–972B, Apr. 1988.
Drawing No. 1300323.
Dual–Lite Emergency Lighting Products, 60–762, Nov. 1997.
Two (2) photographs of Emergi–Lite Preceptor Series Diecast Aluminum Exit Sign.
Emergi–Lite Preceptor Series sales sheets, Aug. 1996, pp. 42–45.
Two (2) photographs of Lithonia Lighting Signature Diecast Aluminum Exit Sign.
Lithonia Lighting Signature sales sheets, 1996, pp. 186–187.
Four (4) photographs of Prescolite Compass Diecast Aluminum Exit Sign.
Prescolite Compass sales sheets, Dec. 1997, pp. 326–327.

*Primary Examiner*—Joanne Silbermann
*Attorney, Agent, or Firm*—Ware, Fressola, Van der Sluys & Adolphson LLP

[57] ABSTRACT

Internally illuminated emergency signs are typically placed in elevated locations which are awkward for electricians to reach, yet must be securely mounted. It is therefore difficult and time-consuming to make wiring connections after the mounting operation is completed. In order to facilitate both quick and easy wiring of the sign, and secure mounting thereof, an improved canopy features a projecting bracket which slips into a slot in a side or top of the sign housing, and engages over horizontally extending screws. Rapid, yet secure mounting of the sign is achieved by cantilevering the sign on the bracket, if side mounting is used, or by use of a locking pin, if top mounting is used. The locking pin keeps the screws from sliding laterally with respect to the bracket.

19 Claims, 5 Drawing Sheets

10B
138
38
37
136
36
12A 6
37
38
138
36
136

4
48
9A
38
17
36
9
9B 10B
3
4
8
14
38
6
37
17
9
36
9B
14

CANOPY MOUNTING DEVICE FOR EXIT SIGN

CROSS-REFERENCE TO RELATED APPLICATION

This application is related to simultaneously filed application Ser. No. 09/124,566, Heaton & Evarts (Ware, Fressola, Van Der Sluys & Adolphson docket no. 64–181), the disclosure of which is hereby incorporated by reference.

BACKGROUND OF THE INVENTION

1. Technical Field

The present invention relates generally to emergency signs and, more particularly, to an exit sign having an improved mounting which facilitates quick and easy installation.

2. Description of the Prior Art

Under current local fire and building codes, buildings to which the public has access are required to have signs identifying the exits. Most of these signs are required to produce a specific intensity of illumination and often must have an emergency backup power source, to provide illumination for a specific minimum period of time, during periods when utility or network power to the building is interrupted, so that persons can find their way, and safely leave the building. Internally illuminated emergency signs are typically mounted in elevated locations by means of canopies which attach to electrical boxes located in walls or ceilings. The signs in these location are awkward for electricians to reach, yet must be securely mounted. It is difficult and time-consuming to make wiring connections after the mounting operation is completed.

Therefore, it would be desirable to provide an engagement between canopy and sign such that the sign which can be rapidly attached or detached, yet in which the sign is secure against accidental dislodgement due to earthquake, vibration, or external impact.

SUMMARY OF THE INVENTION

Accordingly, in order to facilitate both quick and easy wiring of the sign, and secure mounting thereof, an improved canopy features a thin plate-like projecting portion, in the form of a thin, vertically oriented, bracket which slips into a slot in a side or top of the sign housing, and engages over horizontally extending hook means, such as screws. Rapid, yet secure, mounting of the sign is achieved by cantilevering the sign on the bracket, if side mounting is used, or by use of a locking pin, if top mounting is used. Thus, mounting on any generally planar mounting surface, such as a wall, a flat ceiling, or even a sloping ceiling, is possible.

Preferably, the cantilevering of the sign by side mounting is achieved by providing a two-point mounting, in which one hook means, such as a screw, is located above another hook means. This has the result that the weight of the sign itself tends to make the sign want to rotate, exerting a pulling force away from the wall on the upper mounting point, and a pressing force toward the wall on the lower mounting point. This stabilizes the sign in position. In the preferred embodiment, both hook means are on the sign, and the bracket, into which the hook means engage, is on the canopy, but one could equally form the hook means on the canopy and form the bracket on the sign.

The mounting bracket is thin, so the overall thickness of the sign can also be reduced. If the sign housing is a metal casting, e.g. an aluminum casting, reducing the thickness significantly reduces manufacturing expense.

According to a further feature of the invention, the housing comprises two interengaging shells, only a stationary one of which engages the bracket. The other shell is pivotable and is attached by straps to the stationary one, and can be rapidly engaged or disengaged using springy clips which slide inside the stationary shell. Preferably, both shells are rectangular.

According to yet another feature of the invention, the sign housing has removable slot covers or knockouts on its left, right and top side faces, and the canopy can be attached through any of these three slot positions. Preferably, a power cord for the sign can run through the same slot as the mounting bracket.

Further advantageous features of the invention will be apparent from the drawings and the accompanying description.

BRIEF DESCRIPTION OF THE DRAWINGS

FIG. 6 is a front view of the canopy, showing the bracket edge-on;

DETAILED DESCRIPTION OF THE INVENTION

Figure 1:
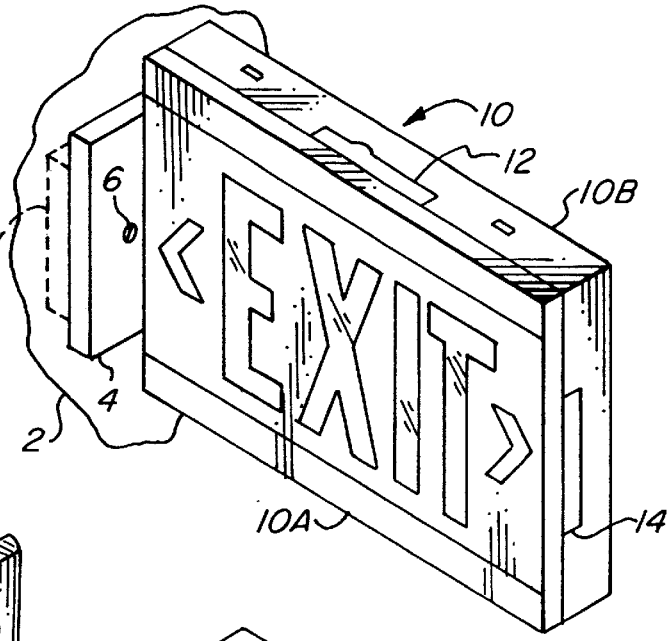
FIG. 1 is a perspective view showing an exit sign embodying the present invention, and mounted on a wall.
Figure 2:
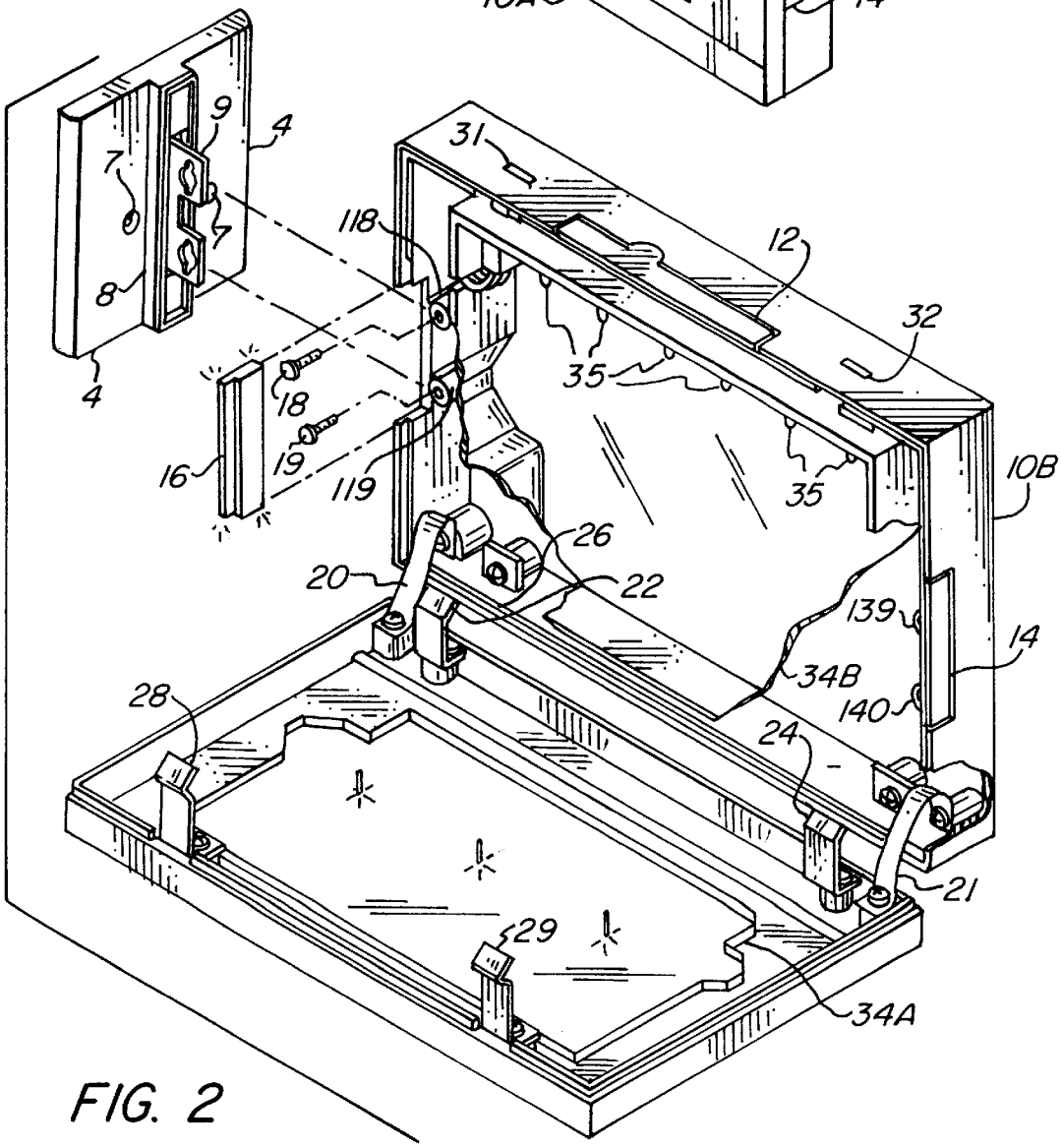
FIG. 2 is an exploded perspective view of the exit sign shown in FIG. 1, with the sign hinged open, and with part of the sign housing removed to permit side mounting on a canopy.

Turning first to FIG. 1, an electrical box 1 is recessed in a wall 2 in a conventional manner. A canopy 4 is mounted on box 1 in a manner well known to those skilled in the art, and preferably is secured by a plurality of fasteners 6, such as screws, inserted through mounting holes 7 in the canopy 4. A sign, generally indicated by the numeral 10 having an interengaging cover shell portion 10A and housing shell portion 10B, is mounted on the canopy 4. The canopy 4 and the shell portions 10A and 10B can be made of cast aluminum. Although a left-side mounting is shown in FIGS. 1 and 2, top mounting or right-side mounting is equally possible as will be explained further hereinafter, by removing rectangular knockouts 12 or 14 on housing shell portion 10B to form a slot is at top or at right, respectively. Top mounting on a ceiling 3 is shown in FIGS. 11–14, described below. When left-mounting or right-mounting is used, the weight of the cantilevered sign suffices to prevent accidental dislodgement.

Figure 5:
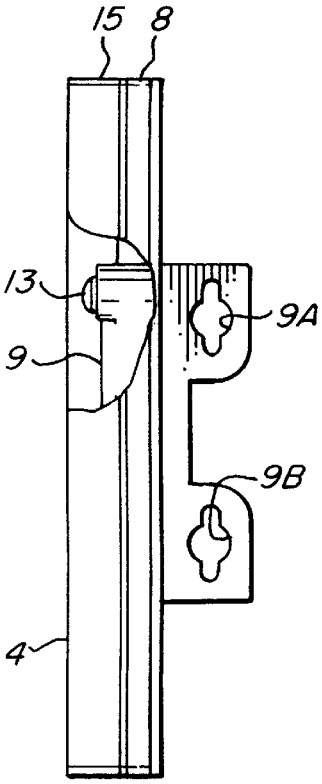
FIG. 5 is a side view of the canopy, partly broken away to show the assembled state of one of the bracket mounting screws.
Figure 7:
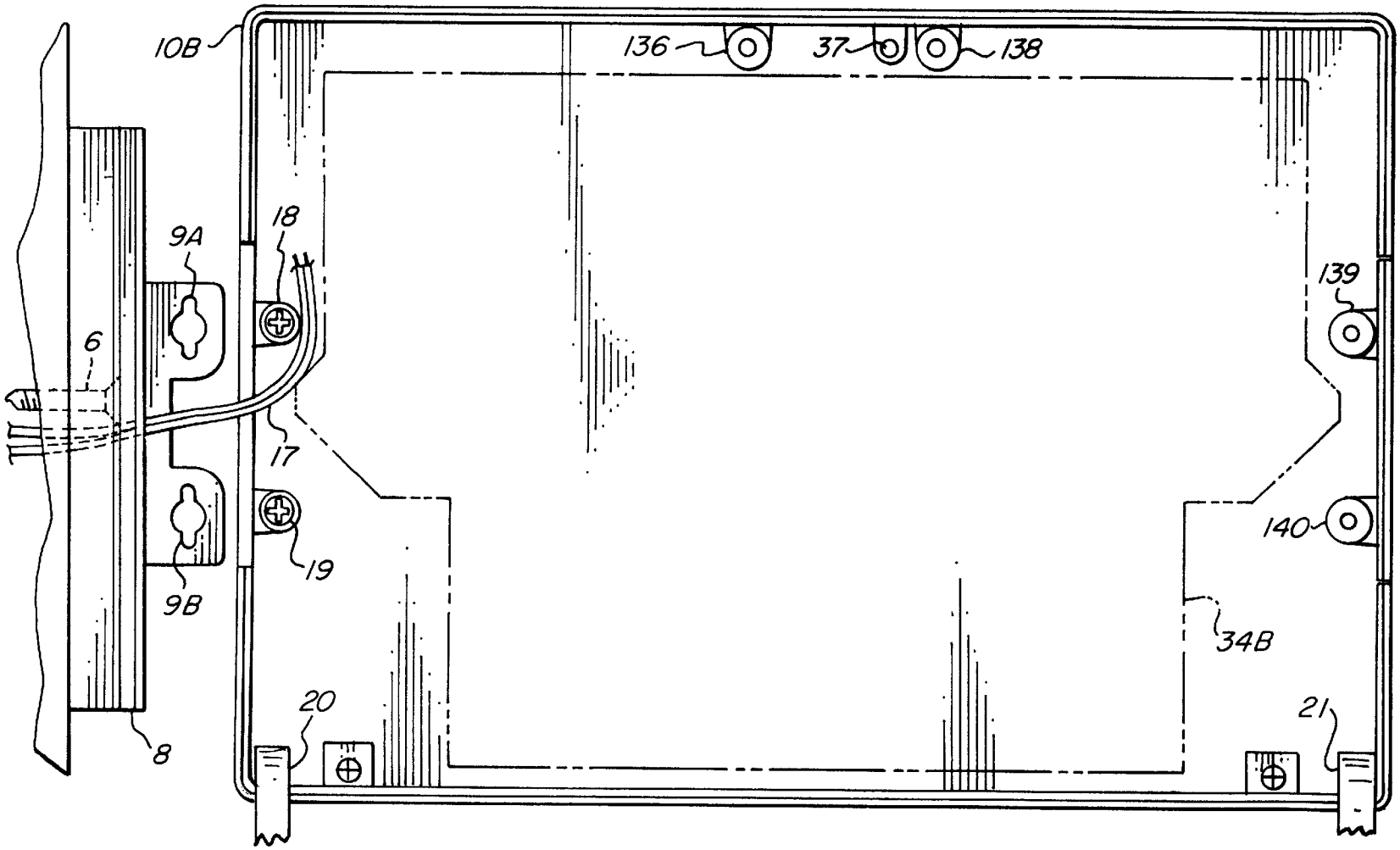
FIG. 7 is a side view of the exit sign of the present invention with its pivotable cover shell in its open position to show the interior of the stationary housing shell of the sign, from which a pivotable cover shell can separate, as shown in FIG. 2, and showing part of the electrical wiring therefor.

In FIG. 2, a left slot knockout 16 is removed to permit the housing shell 10B defining the left slot 16A to be slid into abutting contact with a generally rectangular projection 8 of canopy 4. The knockout 16 can be broken off by the user, for example by means of pliers. Knockouts 12, 14, 16 can be made by forming part of an element with a weakened or frangible border, in a manner well known in the art. Projection 8 frames a generally planar bracket 9, preferably vertically oriented, and formed with a pair of keyhole apertures 9A, 9B (cf. FIG. 5). Bracket 9 preferably comprises a strong material, such as steel. As indicated by dashed lines, upper keyhole 9A and lower keyhole 9B of canopy 4 engage over hook members on sign 10, such as an upper screw 18 and a lower screw 19, which are secured in housing shell portion 10B and which protrude into the left slot area. Screws 18, 19 and bracket 9 collectively constitute interconnection means. Those skilled in the art will appreciate that, instead of the arrangement shown, the bracket could be formed on the sign 10 and the hook member(s) could be formed on the canopy 4. The position of the screws 18, 19 within housing shell 10B is selected so that, in the engaged position, the outer surfaces of shell portions 10A and 10B abut against flat portions of canopy 4. Preferably, housing shell 10B is integrally formed with threaded screw wells 118 and 119, into which screws 18 and 19 are secured. Corresponding threaded screw wells 136, 138, 139, 140 (see FIGS. 2 and 7) are formed at other positions on housing shell 10B, to permit alternative mounting arrangements, as described below.

A pair of flexible straps 20, 21 connect housing shell 10B to pivotable cover shell 10A, preferably near a lower periphery of each. A pair of generally U-shaped lower clips 22, 24, along the lower periphery of cover shell 10A, engage over a flange 26 of housing shell 10B when the shells are pressed together, and a pair of springy upper clips 28, 29 along the upper periphery of cover shell 10A slide inside the top wall 30 of housing shell 10B, and have angled ends which engage respectively in slots 31, 32 in the top wall 30. Preferably, cover shell 10A and housing shell 10B are formed of a durable opaque material such as cast aluminum, and contain respective translucent inserts 34A and 34B, and any conventional lighting means (such as light emitting diodes 35) for transilluminating the inserts.

Figure 3:
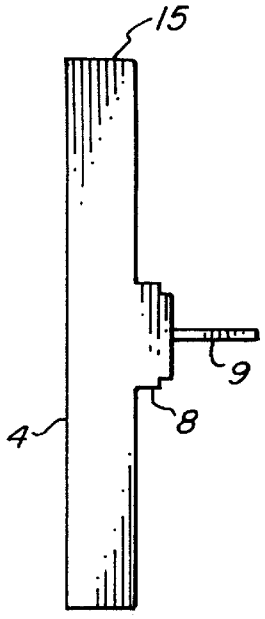
FIG. 3 is an end view along the longitudinal axis of the canopy.
Figure 4:
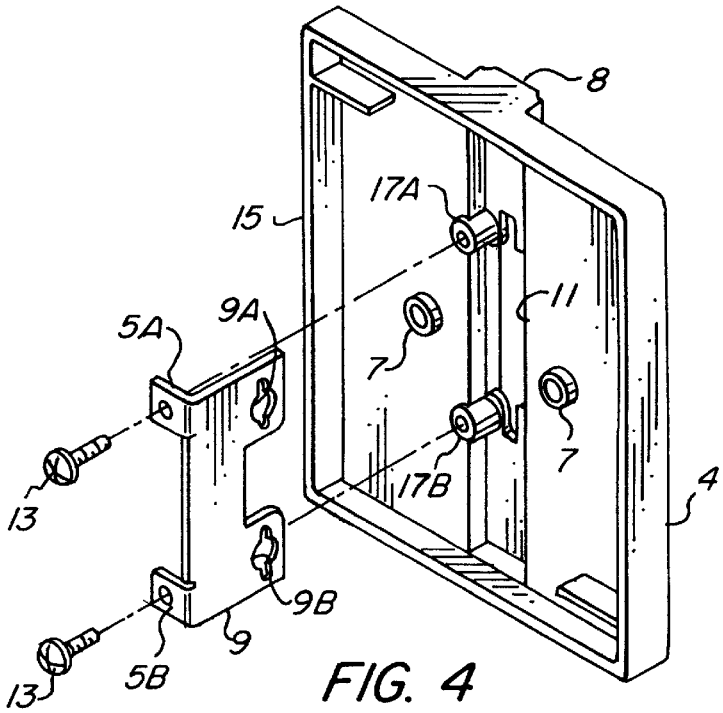
FIG. 4 is a perspective view of a wall-adjacent or ceiling-adjacent side of the canopy, exploded to show how the bracket is screwed into the rear of the canopy.
Figure 6:
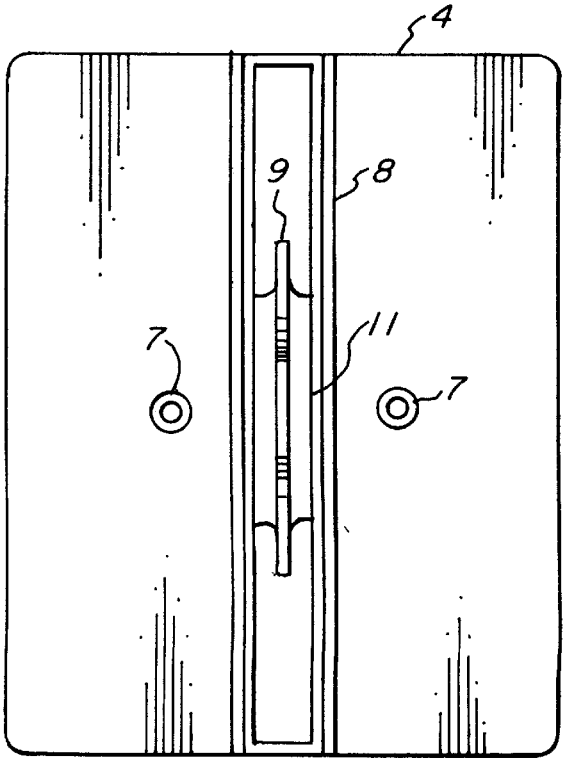

Turning now to FIGS. 3–6, these figures show the structure of canopy 4 in greater detail. The front surface of canopy 4 is formed with a longitudinally extending projection 8, as shown in FIGS. 3 and 6. The leading edge of projection 8 can be slightly narrower than a remaining portion thereof and is adapted to abut against the housing shell 10B. Protruding from projection 8 is a bracket 9. Bracket 9 is preferably L-shaped in cross-section, and has two flanges 5A and 5B, with which bracket 9 is secured by respective screws 13 to the underside of canopy 4. Canopy 4 is formed with a peripheral rim 15 and with respective threaded screw wells 17A and 17B to receive screws 13. Once canopy 4 is secured to a wall or ceiling, flanges 5A and 5B, and screws 13 are hidden from view. The major portion of the bracket 9 extends through a central aperture 11 in canopy 4, to engage with sign 10.

After bracket 9 is secured to canopy 4, a projecting visible portion of bracket 9 is generally C-shaped, and formed with a pair of keyholes 9A, 9B. The keyholes 9A, 9B are preferably symmetrical, so that the same canopy 4 can be used for left mounting or right mounting, as desired. Preferably, each keyhole has a circular central opening, sized to permit passage of a screw head therethrough, and two diametrically opposed narrow necks, sized to receive only the shank portion of a screw 18 or 19, so that portions of the bracket adjacent these necks engage the underside of the screw head, and thereby detain the screws, and any sign attached to or supported by the screws.

Canopy 4 is formed with mounting holes 7 through which screws or other fasteners can be inserted, to secure canopy 4 to a wall. The central aperture 11 in canopy 4 is just tall enough, along its centerline, to allow bracket 9 to pass through. To left and right of the centerline, aperture 11 is shorter, so that bracket 9 is effectively secured against sideways movement. Portions of aperture 11 are wider than bracket 9, so that wiring 17 can be passed through aperture 11 from the back of canopy 4 into the sign, once sign 10 is mounted on the canopy. Typically, one set of wires will extend from the electrical box 1 (FIG. 1) on which canopy 4 is secured, and a second set of wires will be provided within sign housing 10 from lighting means therein to a position near a mounting slot, so that a connection between these two sets of wires can be quickly made, once sign housing 10 has been hung onto canopy 4. Shell 10B can be hung onto canopy 4 while cover shell 10A is still in a hinged-open orientation like that shown in FIG. 2, so that a single installer can make these wiring connections, without needing another person to support the sign during the wiring connection operation.

Turning now to FIGS. 7–10, these show the installation of the sign 10 on the canopy 4. The housing shell 10B is preferably formed not only with respective threaded screw wells 118, 119 for left mounting screws 18, 19, but with a pair of threaded screw wells 136, 138 for top mounting screws 36, 38 and a pair of wells 139, 140 for right mounting screws (not shown). These various screw wells are integrally formed with the housing shell 10B. When top mounting is used, a locking pin 37 is used to prevent accidental dislodgement, as hereinafter described.

Figure 8:
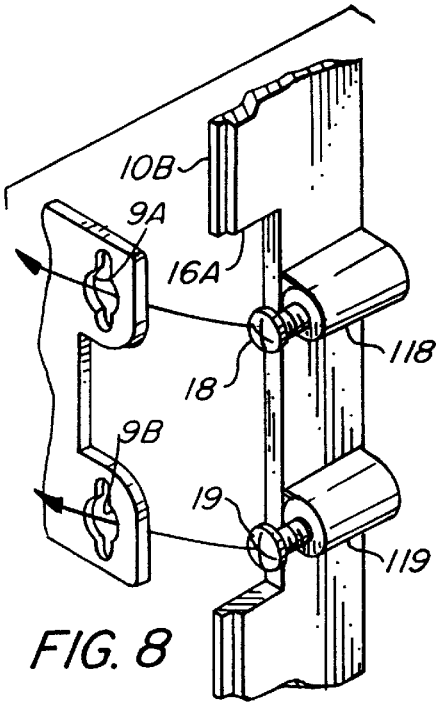
FIG. 8 is a perspective view of the exit sign being mounted to the bracket by means of screws.
Figure 9:
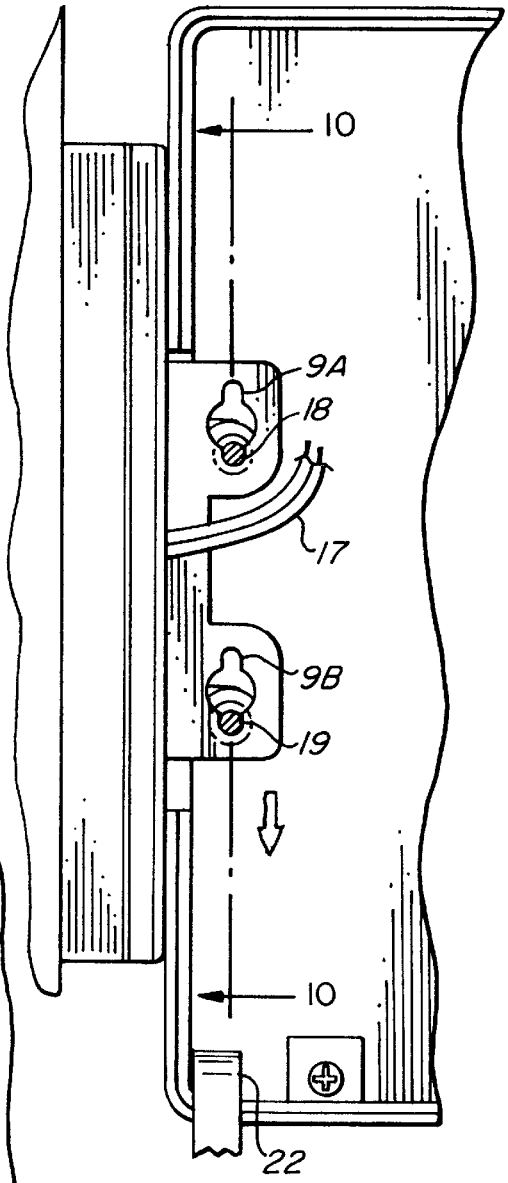
FIG. 9 is a partial side view of the exit sign of the present invention, illustrating the sign and canopy as they are being assembled.
Figure 10:
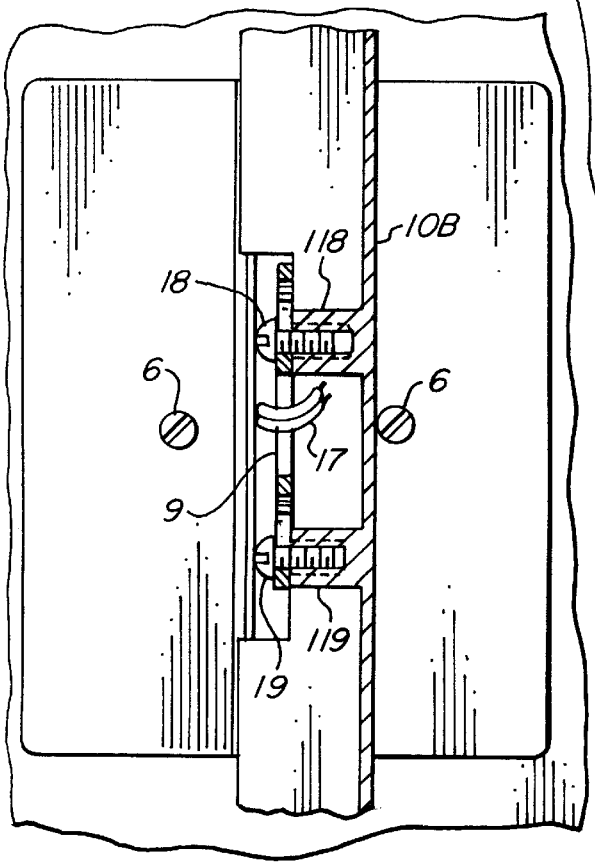
FIG. 10 is a sectional view along the 10—10 line of FIG. 9, showing the screw wells.

The removal of knockout 16 (shown in FIG. 2) leaves an opening, preferably a rectangular slot 16A as shown in FIG. 8. Sign housing shell 10B, with screws 18, 19 already threaded therein, is lifted and guided as shown by the arrows in FIG. 8, until screws 18, 19 pass through keyholes 9A, 9B in bracket 9. Then, shell 10B is lowered slightly, as shown by the downward-pointing arrow in FIG. 9, until the screws are captured in the narrow lower necks of the keyholes. The screws can then be tightened to prevent any wobbling of sign 10 on canopy 4. Thereafter, cover shell 10A can be closed onto shell 10B, hiding screws 18, 19 from view. As will be apparent from FIG. 9, the weight of the sign will tend to cause upper screw 18 to be pulled toward the right, and to cause lower screw 19 to be pushed toward the left, toward the wall. However, since both screws are secured within their respective keyholes against lateral motion, gravity causes the sign to be self-stabilizing on its mounting.

It will be appreciated by those skilled in the art that the sign 10 can be mounted on its right side instead of its left side as previously explained. To mount sign 10 on its right side instead of its left side, screw wells 139 and 140 (shown in FIG. 2) would be used instead of screw wells 118 and 119, resulting in a mounting arrangement which is the mirror-image of that shown in FIG. 9. Instead of removing knock-out 16 for left-side mounting, knockout 14 (FIG. 2) would be removed from shell 10B for right-side mounting.

Figures 11, 12, 13, 14:
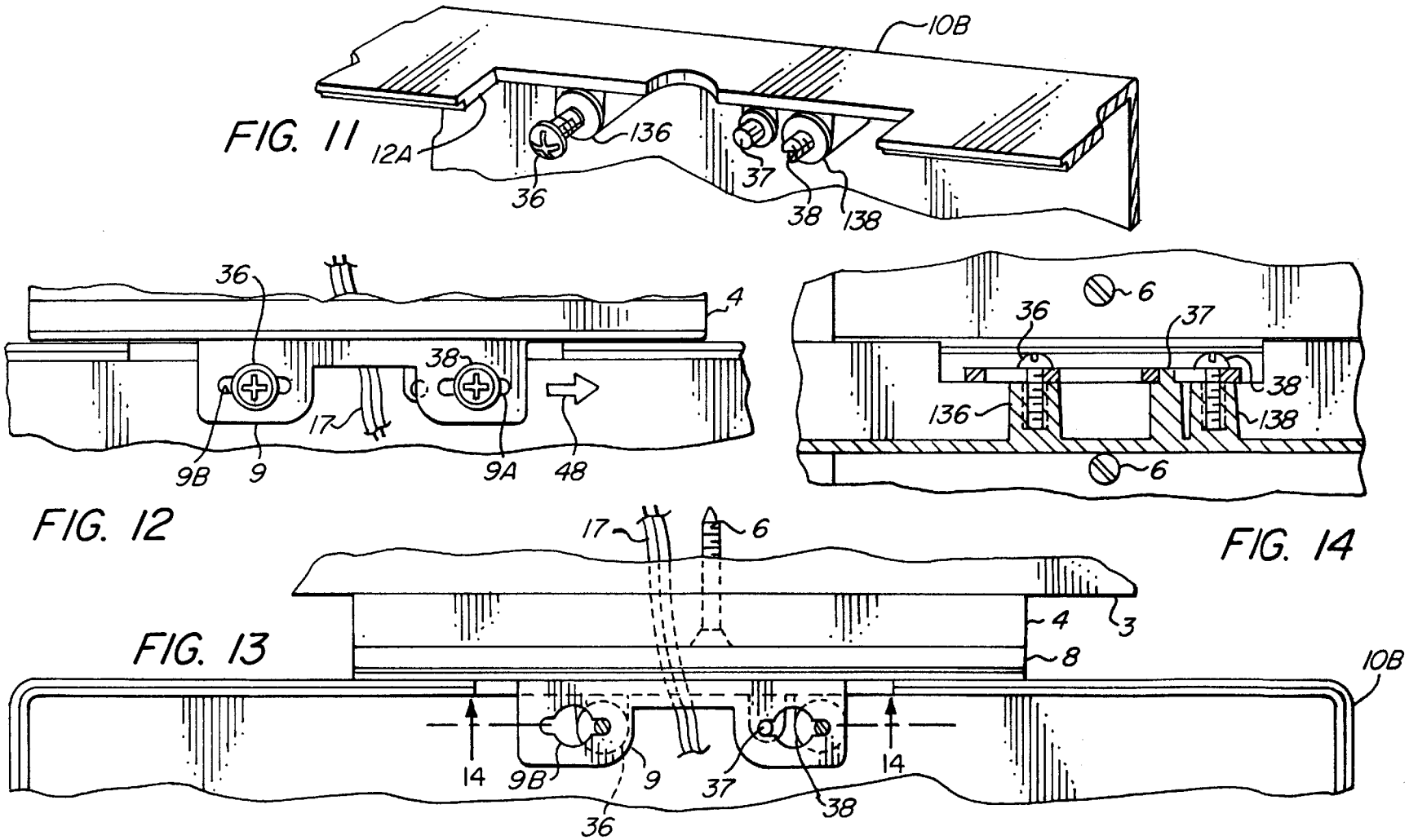
FIG. 11 is an enlarged, partly broken-away perspective view of the top of the stationary housing shell, with part of the housing removed to permit mounting on an overhead canopy.
FIG. 12 is a side view of the top of the housing shell showing the assembly of the overhead canopy and top of the stationary housing shell.
FIG. 13 is a side view of the top of the housing shell, showing a locking pin which engages an opposing end of one keyhole in the bracket, and thereby cooperates to secure the sign on the overhead bracket, against accidental dislodgement.
FIG. 14 is a sectional view along the 14—14 line of FIG. 13, through the bracket, pin, and screws.

Turning now to FIGS. 11–14, these figures illustrate mounting sign 10 by its top, that is, suspending it from canopy 4 secured to a ceiling 3, and securing it by means of a locking pin 37. Knockout 12, shown in FIGS. 1–2, has been removed, so that bracket 9 of canopy 4 can be inserted through the resulting slot 12A. In this orientation, the long axis of keyholes 9A, 9B is horizontal, and one cannot rely on gravity to keep screws 36, 38 in the narrow necks of keyholes 9A, 9B. Instead, housing shell 10B is preferably provided with locking pin 37 formed in housing shell 10B between screw wells 136 and 138. After the screws 36, 38 are secured into screw wells 136 and 138 as shown in FIG. 11, housing shell 10B is positioned adjacent canopy 4 so that screws 36, 38 are centered in respective keyholes 9A, 9*b* in brackets as shown in FIG. 12. During this initial mounting of sign 10, locking pin 37 (as shown in FIG. 12 in phantom) does extend into keyhole 9A, because it is not yet aligned with keyhole 9A, and thus is blocked against insertion into keyhole 9A by bracket 9. When housing shell 10B is slid rightward, as shown by arrow 48, screws 36, 38 slide into the narrow necks of keyholes 9A, 9B and pin 37 can then be positioned into keyhole 9A. As shown in FIGS. 13 and 14, screws 36 and 38 are then tightened to secure sign 10 to canopy 4. With screw 38 in one end of keyhole 9A and locking pin 37 in the other end, sign 10 cannot slide laterally with respect to bracket 9 and become disengaged. To manually disengage sign 10 from canopy 4, the above procedure is reversed.

Various changes and modifications are possible within the scope of the inventive concept, so the invention is not a limited to the particular embodiments shown and described, but rather is defined by the following claims. The claims are intend to cover all of the generic and specific features of the invention herein described, and all statements of the invention which, as a matter of language, might be said to fall therebetween.

What is claimed is:

1. A lighting fixture adapted to be connected to an electrical box mounted in a wall or ceiling comprising:

(a) a canopy adapted to cover the electrical box, said canopy having a thin plate-like projecting portion with a thin plate portion protecting therefrom;

(b) mounting means for providing connection of said canopy to the electrical box;

(c) interconnection means dimensioned for interconnecting said thin plate portion of said canopy with a lighting fixture housing; and (d) a lighting fixture housing adapted for connection with said thin plate portion of said canopy utilizing said interconnection means, said lighting fixture housing having an opening through which said thin plate portion passes into an interior of said lighting fixture housing.

2. A lighting fixture according to claim 1, wherein said interconnection means includes at least one aperture, defined in one of said thin plate-like projecting portion and said lighting fixture housing, and at least one member, on the other of said thin plate-like projecting portion and said lighting fixture housing, matingly engageable with said at least one aperture.

3. A lighting fixture according to claim 2, wherein said thin plate-like projecting portion is a bracket extending from said canopy.

4. A lighting fixture according to claim 1, wherein said canopy has a central aperture defined therein and said thin plate-like projecting portion is a bracket extending through said central aperture.

5. A lighting fixture according to claim 4, wherein said central aperture of said canopy is dimensioned to accommodate passage therethrough of both said bracket and wiring to supply electricity to said lighting fixture housing.

6. A lighting fixture according to claim 1, wherein said canopy is adapted for selective mounting in either a vertical or a horizontal orientation on a planar mounting surface.

7. A lighting fixture according to claim 1, wherein electrical wiring for the lighting fixture extends through said canopy and said opening in said lighting fixture housing.

8. A lighting fixture according to claim 1, wherein said lighting fixture is an illuminated exit sign.

9. A lighting fixture adapted to be connected to an electrical box mounted in a wall or ceiling comprising:

(a) a canopy adapted to cover the electrical box, said canopy having a thin plate-like protecting portion;

(b) mounting means for providing connection of said canopy to the electrical box;

(c) a lighting fixture housing adapted for connection with said canopy utilizing interconnection means, said lighting fixture housing having an opening through which said thin plate-like projecting portion passes into an interior of said lighting fixture housing; and (d) interconnection means dimensioned for interconnecting said canopy with a lighting fixture housing, said interconnection means includes at least one aperture, defined in one of said thin plate-like protecting portion and said lighting fixture housing, and at least one member, on the other of said thin plate-like projecting portion and said lighting fixture housing, matingly engageable with said at least one aperture, said at least one member is at least one screw threadingly received in said lighting fixture housing and dimensionally sized to interfit with said at least one aperture.

10. A lighting fixture adapted to be connected to an electrical box mounted in a wall or ceiling comprising:

(a) a canopy adapted to cover the electrical box, said canopy having a thin plate-like projecting portion;

(b) mounting means for providing connection of said canopy to the electrical box;

(c) a lighting fixture housing adapted for connection with said canopy utilizing interconnection means, said lighting fixture housing having an opening through which said thin plate-like projecting portion passes into an interior of said lighting fixture housing; and (d) interconnection means dimensioned for interconnecting said canopy with said lighting fixture housing, said interconnection means includes at least one aperture, defined in one of said thin plate-like projecting portion and said lighting fixture housing, and at least one member, on the other of said thin plate-like projecting portion and said lighting fixture housing, matingly engageable with said at least one aperture, said at least one aperture comprises first and second apertures spaced from one another in said thin plate-like projecting portion, said first aperture is higher than said second aperture when said canopy is mounted on a vertical surface, whereby, when said at least one member on said lighting fixture housing matingly engages said first and second apertures, said lighting fixture is cantilevered on said thin plate-like projection portion and stabilized by its own weight.

11. A lighting fixture according to claim 10, wherein said at least one member comprises first and second screws threadingly received in said lighting fixture housing and matingly engaging in said first and second apertures, respectively.

12. A lighting fixture adapted to be connected to an electrical box mounted in a wall or ceiling comprising:

(a) a canopy adapted to cover the electrical box, said canopy having a thin plate-like projecting portion;

(b) mounting means for providing connection of said canopy to the electrical box;

(c) a lighting fixture housing adapted for connection with said canopy utilizing interconnection means, said lighting fixture housing having an opening through which said thin plate-like projecting portion passes into an interior of said lighting fixture housing; and (d) interconnection means dimensioned for interconnecting said canopy with said lighting fixture housing, said interconnection means includes at least one aperture, defined in one of said thin plate-like projecting portion and said lighting fixture housing, and at least one member, on the other of said thin plate-like projecting portion and said lighting fixture housing, matingly engageable with said at least one aperture, said interconnection means further includes a locking pin on said lighting fixture housing and engageable with said at least one aperture, along with said at least one member, to secure said lighting fixture housing against lateral movement.

13. A lighting fixture according to claim 12, wherein said at least one aperture comprises first and second apertures spaced from one another in said thin plate-like projecting portion, said at least one member comprises first and second screws threadingly received in said lighting fixture housing and matingly engaging said first and second apertures, respectively.

14. A lighting fixture according to claim 13, wherein said locking pin matingly engages one of said first and second apertures.

15. A lighting fixture adapted to be connected to an electrical box mounted in a wall or ceiling comprising:

(a) a canopy adapted to cover the electrical box, said canopy having a thin plate-like projecting portion, said canopy has a central aperture defined therein and said thin plate-like protecting portion is a bracket extending through said central aperture;

(b) mounting means for providing connection of said canopy to the electrical box;

(c) interconnection means dimensioned for interconnecting said canopy with a lighting fixture housing, said interconnection means includes a plurality of keyholes defined in said bracket, each keyhole having a circular central opening and a pair of diametrically opposed narrow necks extending therefrom; and (d) a lighting fixture housing adapted for connection with said canopy utilizing said interconnection means, said lighting fixture housing having an opening through which said thin plate-like protecting portion passes into an interior of said lighting fixture housing.

16. A lighting fixture adapted to be connected to an electrical box mounted in a wall or ceiling comprising:

(a) a canopy adapted to cover the electrical box and adapted for selective mounting in either a vertical or a horizontal orientation on a planar mounting surface, said canopy having a generally planar front surface surrounded by a peripheral rim which contacts said planar mounting surface, said front surface being formed with a central aperture, a projection extending from said front surface for engagement with a lighting fixture housing; and a bracket secured to an underside of said front surface and extending through said central aperture, said bracket having a thin plate-like projecting portion;

(b) mounting means for providing connection of said canopy to the electrical box;

(c) interconnection means dimensioned for interconnecting said canopy with a lighting fixture housing; and (d) a lighting fixture housing adapted for connection with said canopy utilizing said interconnection means, said lighting fixture housing having an opening through which said thin plate-like projecting portion passes into an interior of said lighting fixture housing.

17. A lighting fixture according to claim 16, wherein said central aperture of said canopy is dimensioned to accommodate passage therethrough of both said bracket and wiring to supply electricity to said lighting fixture housing.

18. A lighting fixture according to claim 16, wherein said interconnection means includes a plurality of keyholes defined in said bracket, each keyhole having a circular central opening and a pair of diametrically opposed narrow necks extending therefrom.

19. A lighting fixture adapted to be connected to an electrical box mounted in a wall or ceiling comprising:

(a) a canopy adapted to cover the electrical box, the canopy having a thin plate-like projecting portion;

(b) mounting means for providing connection of said canopy to the electrical box;

(c) interconnection means dimensioned for interconnecting said canopy with a lighting fixture housing, said interconnection means includes a plurality of keyholes defined in said thin plate-like projecting portion, each keyhole having a circular central opening and a pair of diametrically opposed narrow necks extending therefrom; and (d) a lighting fixture housing adapted for connection with said canopy utilizing said interconnection means, said lighting fixture housing having an opening through which said thin plate-like projecting portion passes into an interior of said lighting fixture housing.

* * * * *

UNITED STATES PATENT AND TRADEMARK OFFICE

CERTIFICATE OF CORRECTION

PATENT NO. : 6,082,031

DATED : July 4, 2000

INVENTOR(S) : Thomas K. Heaton and David A. Evarts

It is certified that error appears in the above-identified patent and that said Letters Patent is hereby corrected as shown below:

In column 3, line 12, "is" should be deleted.

In column 5, line 39, "a" should be deleted.

In column 5, line 51 (claim 1, line 5), "protecting" should be --projecting--.

In column 6, line 25 (claim 9, line 4), "protecting" should be --projecting--.

In column 7, line 51 (claim 15, line 6), "protecting" should be --projecting--.

In column 8, line 4 (claim 15, line 19), "protecting" should be --projecting--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*